US009262926B2

(12) United States Patent
Goldberg et al.

(10) Patent No.: US 9,262,926 B2
(45) Date of Patent: Feb. 16, 2016

(54) USING PASS CODE VERIFICATION TO ORGANIZE A VEHICLE CARAVAN

(71) Applicant: International Business Machines Corporation, Armonk, NY (US)

(72) Inventors: Itzhack Goldberg, Hadera (IL); Gilad Sharaby, Hagalil (IL); Neil Sondhi, Budapest (HU); Yulia Tseytlin, Ben-Ami (IL)

(73) Assignee: GLOBALFOUNDRIES INC., Grand Cayman (KY)

( * ) Notice: Subject to any disclaimer, the term of this patent is extended or adjusted under 35 U.S.C. 154(b) by 347 days.

(21) Appl. No.: 13/898,302

(22) Filed: May 20, 2013

(65) Prior Publication Data

US 2014/0343832 A1 Nov. 20, 2014

(51) Int. Cl.
*G08G 1/00* (2006.01)

(52) U.S. Cl.
CPC ..... *G08G 1/22* (2013.01)

(58) Field of Classification Search
CPC ..... G07C 5/008; G07C 5/085; G07C 2009/00507; G07C 5/006; G07C 5/0808; G07C 5/0858; G07C 5/0891; G07C 9/00134; G07C 9/00309; G06Q 10/06; G06Q 10/0833; G06Q 30/0645; G06Q 40/08; G06Q 10/00; G06Q 10/0639; G06Q 30/0283; G06Q 30/08; G06Q 10/025
See application file for complete search history.

(56) References Cited

U.S. PATENT DOCUMENTS

| | | | |
|---|---|---|---|
| 4,794,394 | A | 12/1988 | Halstead |
| 6,958,707 | B1 | 10/2005 | Siegel |
| 7,099,776 | B2 | 8/2006 | King et al. |
| 7,245,216 | B2 | 7/2007 | Burkley et al. |
| 7,333,820 | B2 | 2/2008 | Sheha et al. |

(Continued)

FOREIGN PATENT DOCUMENTS

| | | | |
|---|---|---|---|
| EP | 1914699 | A2 | 4/2008 |
| WO | 2007121392 | A2 | 10/2007 |
| WO | 2011137477 | A1 | 11/2011 |

OTHER PUBLICATIONS

"Emergency Vehicle Alert , collision avoidance system". [online] [Retrieved on: Mar. 5, 2013]. <http://www.evallc.com/>. Copyright 2003-2010 Eva, LLC.

(Continued)

*Primary Examiner* — Truc M Do
(74) *Attorney, Agent, or Firm* — Scully, Scott, Murphy & Presser, P.C.

(57) ABSTRACT

A reference pass code is received from a first user. Location information of a vehicle of the first user is received from a first computer. A pass code is received from a second user. Location information of a vehicle of the second user is received from a second computer. One or more computer processors verify that the pass code received from the second user matches the reference pass code. Based on verification of the pass code received from the second user, the location information of the vehicle of the first user is transmitted to the second computer and the location information of the vehicle of the second user is transmitted to the first computer.

14 Claims, 3 Drawing Sheets

(56) References Cited

U.S. PATENT DOCUMENTS

| | | | | |
|---|---|---|---|---|
| 2002/0032035 | A1* | 3/2002 | Teshima | 455/456 |
| 2005/0144449 | A1* | 6/2005 | Voice | 713/169 |
| 2006/0224301 | A1* | 10/2006 | Sakagami et al. | 701/200 |
| 2006/0291661 | A1* | 12/2006 | Ramzan et al. | 380/277 |
| 2007/0027614 | A1* | 2/2007 | Reeser et al. | 701/200 |
| 2007/0093958 | A1 | 4/2007 | Jonsson et al. | |
| 2008/0065322 | A1* | 3/2008 | Ng et al. | 701/209 |
| 2010/0202346 | A1* | 8/2010 | Sitzes et al. | 370/328 |
| 2011/0275388 | A1* | 11/2011 | Haney | 455/456.3 |
| 2013/0249713 | A1* | 9/2013 | Adelson | 340/989 |

OTHER PUBLICATIONS

"Driven to make vehicles safer—Lamar University". Enginuity 2011. [online] [Retrieved on: Mar. 5, 2013]. Lamar University Beaumont, US. Copyright 1996-2013. <http://www.lamar.edu/research/research-magazines/enginuity-2011/driven-vehicles-safer.html>.

"Free GPS Navigation with Turn by Turn—Waze". [online] [Retrieved on: Mar. 5, 2013]. <http://www.waze.com>.

"Two Way Radios for Road Trips / Caravan". [online] [Retrieved on: Mar. 5, 2013]. <http://www.buytwowayradios.com/cat/2-way-radios/guide/consumer/use/caravan.aspx>.

* cited by examiner

USING PASS CODE VERIFICATION TO ORGANIZE A VEHICLE CARAVAN

FIELD OF THE INVENTION

The present invention relates generally to organization of a caravan, and more particularly to the verification of a pass code for the purpose of organizing a caravan.

BACKGROUND

Navigation systems have become more and more sophisticated over the last few years. Prior to the technology boom, it was normal to draw out your desired route on a paper map and keep the map open in the car for reference. However, now GPS (global positioning system) navigation systems are able to determine directions, display your location on a digital display and even suggest alternate routes in case of traffic or an emergency. This has simplified the driving experience and helped drivers stay on course with ease. In addition, some unique navigation systems monitor the locations of their subscribers and, in some cases, even publicize the locations of their subscribers for all other subscribers to see.

SUMMARY

Embodiments of the present invention provide a system, method, and program product for verifying a pass code for the purpose of organizing a caravan. A reference pass code is received from a first user. Location information of a vehicle of the first user is received from a first computer. A pass code is received from a second user. Location information of a vehicle of the second user is received from a second computer. One or more computer processors verify that the pass code received from the second user matches the reference pass code. Based on verification of the pass code received from the second user, the location information of the vehicle of the first user is transmitted to the second computer and the location information of the vehicle of the second user is transmitted to the first computer.

DETAILED DESCRIPTION

Figure 1:
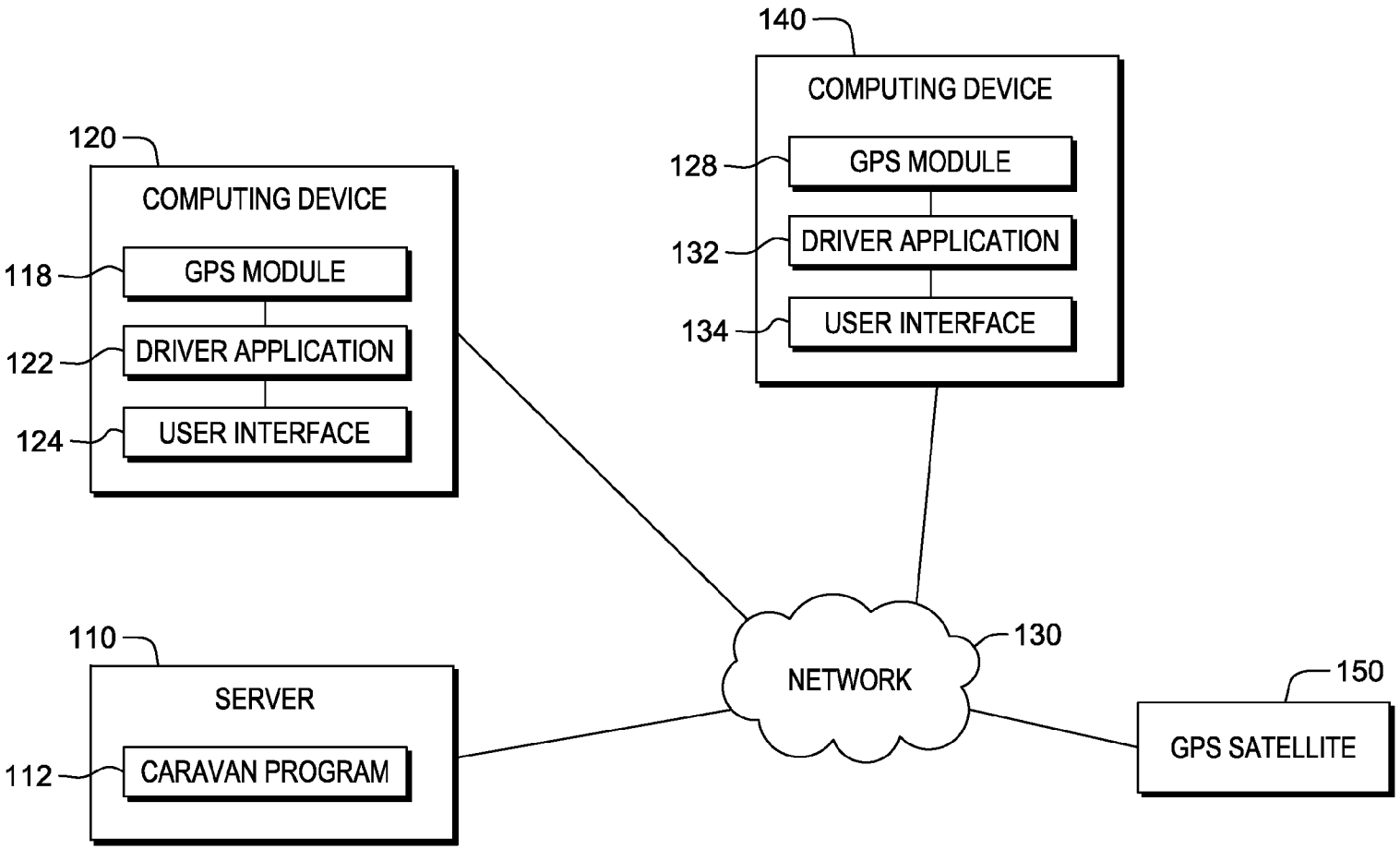
FIG. 1 illustrates a caravan monitoring system, in accordance with an embodiment of the invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer-readable medium(s) having computer readable program code/instructions embodied thereon.

Any combination of one or more computer-readable medium(s) may be utilized. The computer-readable medium may be a computer-readable signal medium or a computer-readable storage medium. A computer-readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer-readable storage medium would include the following: an electrical connection having one or more wires, a portable computer diskette, a hard disk, a random access memory (RAM), a read-only memory (ROM), an erasable programmable read-only memory (EPROM or flash memory), an optical fiber, a portable compact disc read-only memory (CD-ROM), an optical storage device, a magnetic storage device, or any suitable combination of the foregoing. In the context of this document, a computer-readable storage medium may be any tangible medium that can contain, or store a program for use by or in connection with an instruction execution system, apparatus, or device.

A computer-readable signal medium may include a propagated data signal with computer-readable program code embodied therein, for example, in baseband or as part of a carrier wave. Such a propagated signal may take any of a variety of forms, including, but not limited to, electro-magnetic, optical, or any suitable combination thereof. A computer-readable signal medium may be any computer-readable medium that is not a computer-readable storage medium and that can communicate, propagate, or transport a program for use by or in connection with an instruction execution system, apparatus, or device.

Program code embodied on a computer-readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on a user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable medium that can direct a computer, other programmable data processing apparatus, or other devices to function in a particular manner, such that the instructions stored in the computer-readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer-implemented process such that the instructions which execute on the computer or other programmable apparatus provide processes for implementing the functions/acts specified in the flowchart and/or block diagram block or blocks.

Embodiments of the present invention will now be described in detail with reference to the accompanying Figures.

FIG. 1 illustrates caravan monitoring system 100, in accordance with an embodiment of the invention. Caravan monitoring system 100 includes server 110, computing device 120, computing device 140, and GPS satellite 150 all interconnected over network 130.

In an exemplary embodiment, network 130 is the Internet, representing a worldwide collection of networks and gateways to support communications between devices connected to the Internet. Network 130 may include, for example, wired, wireless or fiber optic connections. In other embodiments, network 130 may be implemented as an intranet, a local area network (LAN), or a wide area network (WAN). In general, network 130 can be any combination of connections and protocols that will support communications between server 110, computing device 120, computing device 140, and GPS satellite 150.

Computing device 120 includes GPS module 118, driver application 122 and user interface 124. Computing device 120 may be a desktop computer, a notebook, a laptop computer, a tablet computer, a handheld device, a smart-phone, a thin client, or any other electronic device or computing system capable of receiving and sending data to and from server 110 and/or computing device 140 via network 130. Computing device 120 is described in more detail with reference to FIG. 3.

GPS module 118 includes components used to determine information regarding the location of computing device 120 by way of communication with GPS satellite 150 via network 130. In the exemplary embodiment, GPS module 118 is a software application, however, in other embodiments, GPS module 118 may be a hardware or firmware device. In the exemplary embodiment, GPS module 118 is fully integrated with driver application 122, however, in other embodiments, GPS module 118 may be only partially integrated or completely separate from driver application 122.

User interface 124 includes components used to receive input from a user and transmit the input to driver application 122. User interface 124 uses a combination of technologies and devices, such as device drivers, to provide a platform to enable users to interact with driver application 122. In the exemplary embodiment, user interface 124 receives input, such as textual input received from a physical input device, such as a keyboard, via a device driver that corresponds to the physical input device.

Driver application 122 is a software application that is capable of receiving input from a user and transmitting the input to server 110 and/or computing device 140 via network 130. In the exemplary embodiment, driver application 122 is also capable of receiving information from server 110 and/or computing device 140 via network 130 and displaying the received information to a user via user interface 124.

Computing device 140 includes GPS module 128, driver application 132 and user interface 134. Computing device 140 may be a desktop computer, a notebook, a laptop computer, a tablet computer, a handheld device, a smart-phone, a thin client, or any other electronic device or computing system capable of receiving and sending data to and from server 110 and/or computing device 120 via network 130. Computing device 140 is described in more detail with reference to FIG. 3.

GPS module 128 includes components used to determine information regarding the location of computing device 140 by way of communication with GPS satellite 150 via network 130. In the exemplary embodiment, GPS module 128 is a software application, however, in other embodiments, GPS module 128 may be a hardware or firmware device. In the exemplary embodiment, GPS module 128 is fully integrated with driver application 132, however, in other embodiments, GPS module 128 may be only partially integrated or completely separate from driver application 132.

User interface 134 includes components used to receive input from a user and transmit the input to driver application 132. User interface 134 uses a combination of technologies and devices, such as device drivers, to provide a platform to enable users to interact with driver application 132. In the exemplary embodiment, user interface 134 receives input, such as textual input received from a physical input device, such as a keyboard, via a device driver that corresponds to the physical input device.

Driver application 132 is a software application that is capable of receiving input from a user and transmitting the input to server 110 and/or computing device 120 via network 130. In the exemplary embodiment, driver application 132 is also capable of receiving information from server 110 and/or computing device 120 via network 130 and displaying the received information to a user via user interface 134.

Server 110 includes caravan program 112. Server 110 may be a desktop computer, a notebook, a laptop computer, a tablet computer, a handheld device, a smart-phone, a thin client, or any other electronic device or computing system capable of receiving and sending data to and from server 110 and/or computing device 120 via network 130. Server 110 is described in more detail with reference to FIG. 3.

Caravan program 112 is a software application capable of receiving a pass code from driver application 122 and/or driver application 132 via network 130 and determining if the received pass code matches a previously stored reference pass code. In the exemplary embodiment, caravan program 112 is also capable of receiving and transmitting location information to computing device 120 and/or computing device 140 via network 130. The operation of caravan program 112 is described in further detail below with reference to FIG. 2.

GPS satellite 150 is a hardware device capable of receiving and transmitting location information to GPS modules such as GPS module 128 and GPS module 118.

Figure 2:
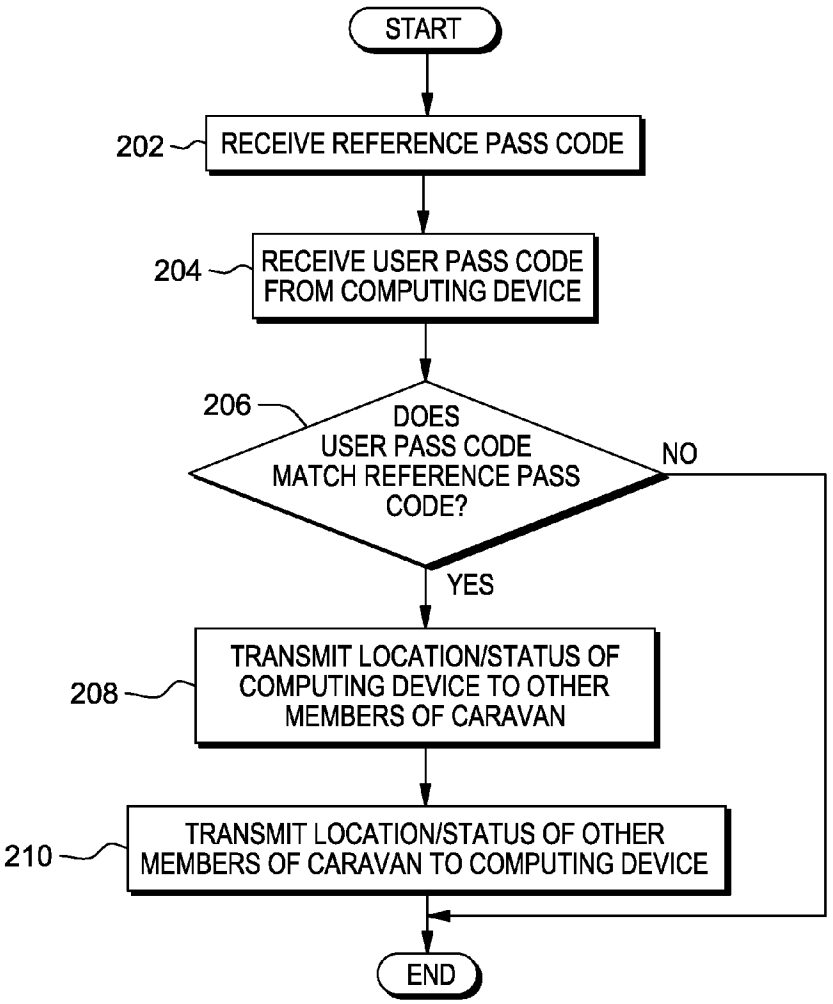
FIG. 2 is a flowchart illustrating the operations of the caravan program of FIG. 1 in verifying a pass code in order to determine if a vehicle can join a caravan, in accordance with an embodiment of the invention.

FIG. 2 is a flowchart illustrating the operations of caravan program 112 in verifying a pass code in order to determine if a vehicle can join a caravan, in accordance with an exemplary embodiment of the invention. In an exemplary embodiment, caravan program 112 receives a reference pass code from driver application 122 via network 130 and stores the reference pass code in memory (step 202). In the exemplary embodiment, the user of computing device 120 inputs the reference pass code into driver application 122 via user interface 124. Driver application 122 then transmits the reference pass code to caravan program 112 via network 130. In other embodiments, the reference pass code can be received by a user or administrator of server 110 from the user of computing device 120, over the phone or by another means of communication, and then input into caravan program 112 via a user interface by the user or administrator of server 110. Caravan program 112 then saves the reference pass code in memory. In further embodiments, caravan program 112 may use voice recognition software to receive the reference pass code from the user of computing device 120 over the phone or by another means of communication Overall, a pass code may comprise of written components, such as, numbers, symbols, shapes, etc., auditory or visual components or any other communicative expression. In addition, in the exemplary embodiment, when caravan program 112 receives the reference pass code from driver application 122, caravan program 112 begins a caravan with the vehicle of the user of computing device 120 being the first member. In other embodiments, if the user of computing device 120 does not wish to begin the caravan immediately after submitting the reference pass code, caravan program 112 may require the user of computing device 120 to input the pass code, for verification purposes, via driver application 122 at a later time when the user of computing device 120 desires to begin the caravan.

Caravan program 112 then receives a user pass code from driver application 132 via network 130 (step 204). In the exemplary embodiment, the user of computing device 140 inputs the user pass code into driver application 132 via user interface 134. Driver application 132 then transmits the user pass code to caravan program 112 via network 130. As stated above, a pass code may comprise of written components, such as, numbers, symbols, shapes, etc., auditory or visual components or any other communicative expression.

Caravan program 112 then determines if the user pass code received from driver application 132 matches the reference pass code (decision 206). In the exemplary embodiment, caravan program 112 determines if the user pass code matches the reference pass code exactly, however, in other embodiments, caravan program 112 determines if the user pass code matches within a threshold percentage of the reference pass code.

If caravan program 112 determines that the user pass code does not match the reference pass code (decision 206, "NO" branch), caravan program 112 does not allow the vehicle associated with the user of computing device 140 to join the caravan.

If caravan program 112 determines that the user pass code does match the reference pass code (decision 206, "YES" branch), caravan program 112 transmits the location information of the vehicle associated with the user of computing device 140 to the computing devices associated with the other vehicles in the caravan, i.e., computing device 120 (step 208). In the exemplary embodiment, the location information is received by driver application 122 and displayed to the user of computing device 120 via user interface 124. In other embodiments, caravan program 112 may also transmit other information, such as status information, with the location information transmitted to computing device 120. For example, if the vehicle associated with computing device 140 is in an emergency situation or in need of assistance, caravan program 112 transfers this status information of the vehicle associated with computing device 140 to computing device 120.

In addition, if caravan program 112 determines that the user pass code does match the reference pass code (decision 206, "YES" branch), caravan program 112 also transmits the location information of the other vehicles associated with the caravan, i.e., computing device 120, to driver application 132 via network 130 (step 210). As stated above, in other embodiments, caravan program 112 may also transmit other information, such as status information, with the location information transmitted to driver application 132. Furthermore, the same methodology may be applied if additional vehicles desire to join the caravan.

The foregoing description of various embodiments of the present invention has been presented for purposes of illustration and description. It is not intended to be exhaustive nor to limit the invention to the precise form disclosed. Many modifications and variations are possible. Such modifications and variations that may be apparent to a person skilled in the art of the invention are intended to be included within the scope of the invention as defined by the accompanying claims.

Figure 3:
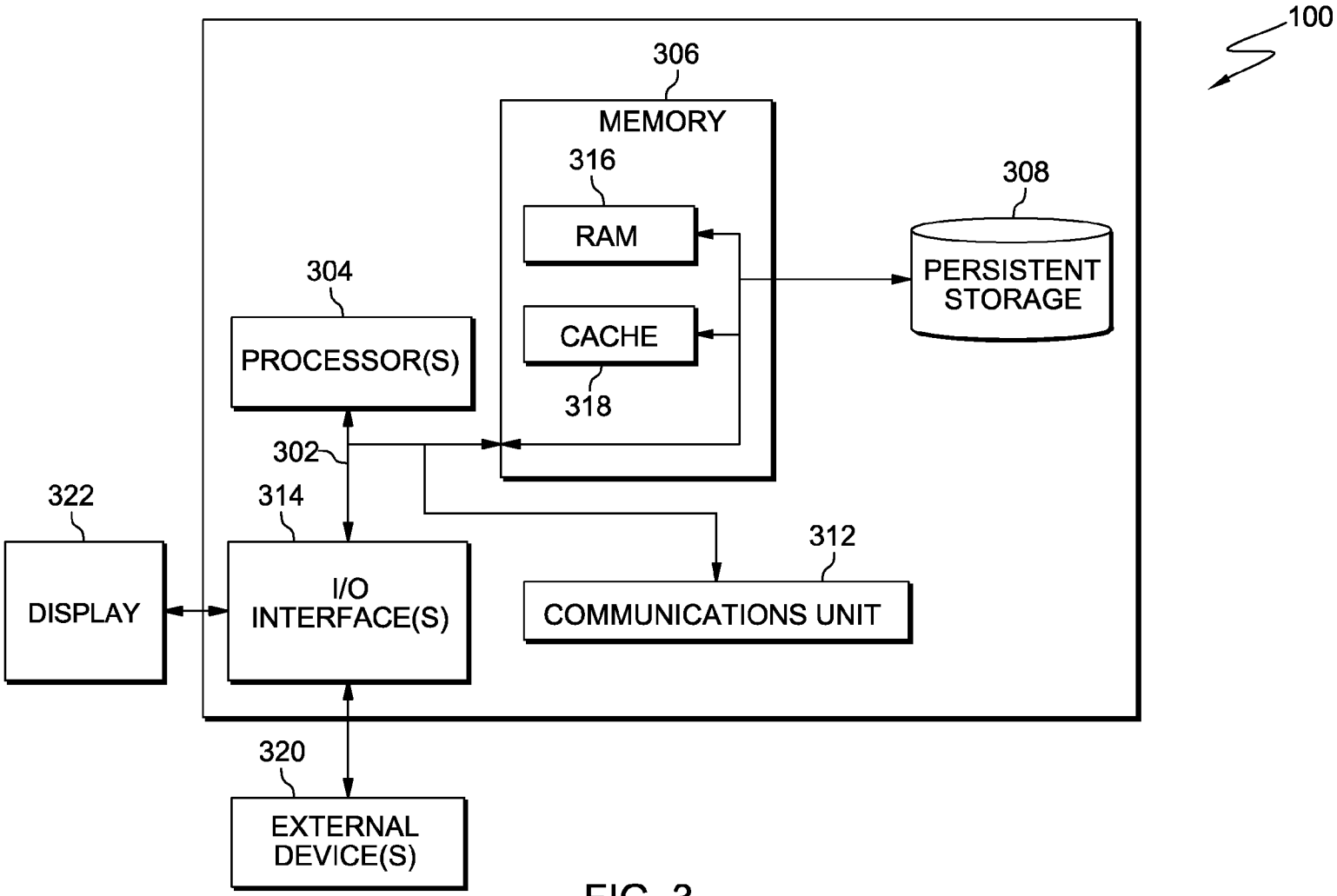
FIG. 3 is a block diagram depicting the hardware components of the caravan monitoring system of FIG. 1, in accordance with an embodiment of the invention.

FIG. 3 depicts a block diagram of components of server 110, computing device 120, computing device 140, and satellite 150, in accordance with an illustrative embodiment of the present invention. It should be appreciated that FIG. 3 provides only an illustration of one implementation and does not imply any limitations with regard to the environments in which different embodiments may be implemented. Many modifications to the depicted environment may be made.

Server 110, computing device 120, computing device 140, and satellite 150 include communications fabric 302, which provides communications between computer processor(s) 304, memory 306, persistent storage 308, communications unit 312, and input/output (I/O) interface(s) 314. Communications fabric 302 can be implemented with any architecture designed for passing data and/or control information between processors (such as microprocessors, communications and network processors, etc.), system memory, peripheral devices, and any other hardware components within a system. For example, communications fabric 302 can be implemented with one or more buses.

Memory 306 and persistent storage 308 are computer-readable storage media. In this embodiment, memory 306 includes random access memory (RAM) 316 and cache memory 318. In general, memory 306 can include any suitable volatile or non-volatile computer-readable storage media.

The programs caravan program 112 in server 110; programs GPS module 118, driver application 122, and user interface 124 in computing device 120, and programs GPS module 128, driver application 132 and user interface 134 in computing device 140 are stored in persistent storage 308 for execution by one or more of the respective computer processors 304 via one or more memories of memory 306. In this embodiment, persistent storage 308 includes a magnetic hard disk drive. Alternatively, or in addition to a magnetic hard disk drive, persistent storage 308 can include a solid state hard drive, a semiconductor storage device, read-only memory (ROM), erasable programmable read-only memory (EPROM), flash memory, or any other computer-readable storage media that is capable of storing program instructions or digital information.

The media used by persistent storage 308 may also be removable. For example, a removable hard drive may be used for persistent storage 308. Other examples include optical and magnetic disks, thumb drives, and smart cards that are inserted into a drive for transfer onto another computer-readable storage medium that is also part of persistent storage 308.

Communications unit 312, in these examples, provides for communications with other data processing systems or devices. In these examples, communications unit 312 includes one or more network interface cards. Communications unit 312 may provide communications through the use of either or both physical and wireless communications links. The programs caravan program 112 in server 110; programs GPS module 118, driver application 122, and user interface 124 in computing device 120, and programs GPS module 128, driver application 132 and user interface 134 in computing device 140 may be downloaded to persistent storage 308 through communications unit 312.

I/O interface(s) 314 allows for input and output of data with other devices that may be connected to server 110 and computing device 120. For example, I/O interface 314 may provide a connection to external devices 320 such as a keyboard, keypad, a touch screen, and/or some other suitable input device. External devices 320 can also include portable computer-readable storage media such as, for example, thumb drives, portable optical or magnetic disks, and memory cards. Software and data used to practice embodiments of the present invention, e.g., the programs caravan program 112 in server 110; programs GPS module 118, driver application 122, and user interface 124 in computing device 120, and programs GPS module 128, driver application 132 and user interface 134 in computing device 140, can be stored on such portable computer-readable storage media and can be loaded onto persistent storage 308 via I/O interface(s) 314. I/O interface(s) 314 also connect to a display 322.

Display 322 provides a mechanism to display data to a user and may be, for example, a computer monitor.

The programs described herein are identified based upon the application for which they are implemented in a specific embodiment of the invention. However, it should be appreciated that any particular program nomenclature herein is used merely for convenience, and thus the invention should not be limited to use solely in any specific application identified and/or implied by such nomenclature.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

What is claimed is:

1. A method for forming a caravan, comprising the steps of:

receiving a reference pass code from a first user;

receiving location information of a vehicle of the first user from a first computer;

receiving a pass code from a second user;

receiving location information of a vehicle of the second user from a second computer;

verifying, by one or more computer processors, that the pass code received from the second user matches the reference pass code; and based on verification of the pass code received from the second user, transmitting the location information of the vehicle of the first user to the second computer and transmitting the location information of the vehicle of the second user to the first computer, wherein the location information of the vehicle of the first user is transmitted to the second computer and the location information of the vehicle of the second user is transmitted to the first computer when the vehicle of the first user and the vehicle of the second user are within a threshold distance of each other.

2. The method of claim 1, further comprising the steps of:

receiving a pass code from the first user;

verifying, by one or more computer processors, that the pass code received from the first user matches the reference pass code; and wherein the step of transmitting the location information of the vehicle of the first user to the second user and transmitting the location information of the vehicle of the second user to the first user is based on verification of the pass code received from the first user and verification of the pass code received from the second user.

3. The method of claim 1, further comprising the step of transmitting a status of the vehicle of the first user to the second computer and transmitting a status of the vehicle of the second user to the first computer, based on verification of the pass code received from the second user.

4. The method of claim 3, further comprising the step of notifying an emergency authority based on either the status of the vehicle of the first user or the status of the vehicle of the second user.

5. The method of claim 4, further comprising the step of transmitting the location information of the vehicle of the first user or the location information of the vehicle of the second user to the emergency authority.

6. A computer program product for forming a caravan, the computer program product comprising:

one or more computer-readable storage devices and program instructions stored on at least one of the one or more tangible storage devices, the program instructions comprising:

program instructions to receive a reference pass code from a first user;

program instructions to receive location information of a vehicle of the first user from a first computer;

program instructions to receive a pass code from a second user;

program instructions to receive location information of a vehicle of the second user from a second computer;

program instructions to verify that the pass code received from the second user matches the reference pass code; and based on verification of the pass code received from the second user, program instructions to transmit the location information of the vehicle of the first user to the second computer and transmit the location information of the vehicle of the second user to the first computer, and further comprising:

program instructions to transmit a status of the vehicle of the first user to the second computer and transmit a status of the vehicle of the second user to the first computer, based on verification of the pass code received from the second user, and program instructions to notify an emergency authority based on either the status of the vehicle of the first user or the status of the vehicle of the second user.

7. The computer program product of claim 6, further comprising:

program instructions to receive a pass code from the first user;

program instructions to verify that the pass code received from the first user matches the reference pass code; and wherein the program instructions to transmit the location information of the vehicle of the first user to the second user and transmit the location information of the vehicle of the second user to the first user is based on verification of the pass code received from the first user and verification of the pass code received from the second user.

8. The computer program product of claim 6, wherein the location information of the vehicle of the first user is transmitted to the second computer and the location information of the vehicle of the second user is transmitted to the first computer when the vehicle of the first user and the vehicle of the second user are within a threshold distance of each other.

9. The computer program product of claim 6, further comprising program instructions to transmit the location information of the vehicle of the first user or the location information of the vehicle of the second user to the emergency authority.

10. A computer system for forming a caravan, the computer system comprising:

one or more processors, one or more computer-readable memories, one or more computer-readable tangible storage devices, and program instructions stored on at least one of the one or more storage devices for execution by at least one of the one or more processors via at least one of the one or more memories, the program instructions comprising:

program instructions to receive a reference pass code from a first user;

program instructions to receive location information of a vehicle of the first user from a first computer;

program instructions to receive a pass code from a second user;

program instructions to receive location information of a vehicle of the second user from a second computer;

program instructions to verify that the pass code received from the second user matches the reference pass code; and based on verification of the pass code received from the second user, program instructions to transmit the location information of the vehicle of the first user to the second computer and transmit the location information of the vehicle of the second user to the first computer, wherein the location information of the vehicle of the first user is transmitted to the second computer and the location information of the vehicle of the second user is transmitted to the first computer when the vehicle of the first user and the vehicle of the second user are within a threshold distance of each other.

11. The computer system of claim 10, further comprising:

program instructions to receive a pass code from the first user;

program instructions to verify that the pass code received from the first user matches the reference pass code; and wherein the program instructions to transmit the location information of the vehicle of the first user to the second user and transmit the location information of the vehicle of the second user to the first user is based on verification of the pass code received from the first user and verification of the pass code received from the second user.

12. The computer system of claim 10, further comprising program instructions to transmit a status of the vehicle of the first user to the second computer and transmit a status of the vehicle of the second user to the first computer, based on verification of the pass code received from the second user.

13. The computer system of claim 12, further comprising program instructions to notify an emergency authority based on either the status of the vehicle of the first user or the status of the vehicle of the second user.

14. The computer system of claim 13, further comprising program instructions to transmit the location information of the vehicle of the first user or the location information of the vehicle of the second user to the emergency authority.

* * * * *